US008878741B2

(12) United States Patent
Mosallaei

(10) Patent No.: US 8,878,741 B2
(45) Date of Patent: Nov. 4, 2014

(54) TUNABLE NEGATIVE PERMEABILITY BASED DEVICES

(75) Inventor: Hossein Mosallaei, Brookline, MA (US)

(73) Assignee: Northeastern University, Boston, MA (US)

( * ) Notice: Subject to any disclaimer, the term of this patent is extended or adjusted under 35 U.S.C. 154(b) by 471 days.

(21) Appl. No.: 13/144,847

(22) PCT Filed: Jan. 14, 2010

(86) PCT No.: PCT/US2010/021012
§ 371 (c)(1), (2), (4) Date: Jul. 15, 2011

(87) PCT Pub. No.: WO2010/083288
PCT Pub. Date: Jul. 22, 2010

(65) Prior Publication Data

US 2011/0273319 A1 Nov. 10, 2011

Related U.S. Application Data

(60) Provisional application No. 61/145,289, filed on Jan. 16, 2009.

(51) Int. Cl.
*H01Q 1/00* (2006.01)
*H01Q 15/00* (2006.01)

(52) U.S. Cl.
CPC ..... *H01Q 15/0086* (2013.01)
USPC ..... 343/787

(58) Field of Classification Search
USPC ..... 343/787, 700 MS, 745, 893; 342/1
See application file for complete search history.

(56) References Cited

U.S. PATENT DOCUMENTS

| | | | | |
|---|---|---|---|---|
| 8,125,391 | B2 * | 2/2012 | Knudsen | 343/700 MS |
| 2008/0136563 | A1 * | 6/2008 | Duwel et al. | 333/186 |
| 2008/0204164 | A1 * | 8/2008 | Eleftheriades | 333/134 |

* cited by examiner

*Primary Examiner* — Seung Lee
(74) *Attorney, Agent, or Firm* — Wilmer Cutler Pickering Hale and Dorr LLP

(57) ABSTRACT

Negative permeability metamaterials and devices based on negative permeability metamaterials are described. The invention presents a new paradigm for realizing electromagnetic devices utilizing naturally available magnetic materials operating in their negative permeability spectrum. The superior advantages of negative permeability materials are utilized for providing unique electromagnetic devices including, for example, small antennas, array sensors and imaging devices. Since the property of the magnetic materials can be tuned by applying a DC magnetic field, the materials and devices of the present invention can be tunable.

43 Claims, 11 Drawing Sheets

TUNABLE NEGATIVE PERMEABILITY BASED DEVICES

CROSS-REFERENCE TO RELATED APPLICATIONS

This application claims the benefit of U.S. Provisional Application No. 61/145,289, filed Jan. 16, 2009, entitled "Tunable Positive-Negative Permeability Devices."

STATEMENT REGARDING FEDERALLY SPONSORED RESEARCH OR DEVELOPMENT

N/A

BACKGROUND OF THE INVENTION

Advanced materials are prime enablers of high-tech devices. The next generation of electromagnetic devices should be smaller in size and offer state-of-the-art physical and engineering features.

Metamaterials are a class of new materials where by tailoring metallic or dielectric elements, one can artificially achieve electric and magnetic dipole modes and offer a medium with constitutive parameters of interest ($\pm\in,\pm\mu$). However, although theoretical investigations demonstrate that metamaterials can possess very unique physical features, in reality it is very challenging to construct practical devices using metamaterials, primarily because of the difficulty in fabricating these materials, as well as the fact that they tend to also have certain undesirable properties, such as high-loss and narrow bandwidth.

BRIEF SUMMARY OF THE INVENTION

According to one aspect, the present invention is directed to negative permeability metamaterials and devices based on negative permeability metamaterials. The present invention presents an entirely new paradigm for realizing electromagnetic devices utilizing naturally available magnetic materials operating in their negative permeability spectrum. Ferrites have previously been used in microwave circuit technology, such as in the design of circulators, phase shifters and isolators, for example. However, these prior ferrite-based devices utilize the positive permeability band of the magnetic materials. In the present invention, the superior advantages of negative permeability materials are utilized for providing unique electromagnetic components with state-of-the-art features. Such devices include, for example, small antennas, array sensors and imaging devices. Furthermore, since the property of the present magnetic materials can be tuned by applying a DC magnetic field, the materials and devices of the present invention can be tunable.

BRIEF DESCRIPTION OF THE SEVERAL VIEWS OF THE DRAWINGS

Further aspects of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
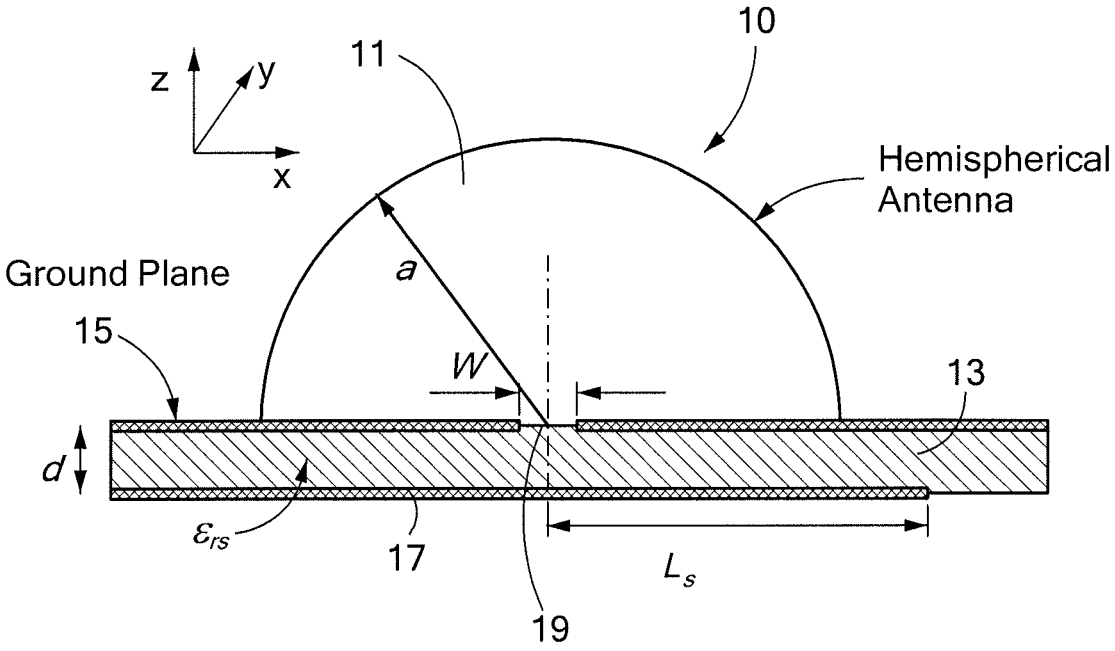
FIG. 1 is a cross-sectional illustration of a negative permeability-based hemispherical antenna.

This application claims the benefit of U.S. Provisional Application No. 61/145,289, filed Jan. 16, 2009, entitled "Tunable Positive-Negative Permeability Devices," the entire teachings of which are incorporated herein by reference.

Negative Permeability-Based Antennas

Small antennas with wideband impedance characteristics are of significant interest in many areas, such as in modern wireless systems. One challenge in designing small antennas is to squeeze the resonant dimension of the antenna while maintaining other radiation features. In general, this is achieved through either tailoring the antenna topology, or by engineering the material substrate. One of the most conventional techniques for antenna miniaturization is to print a patch radiator on a grounded, high-dielectric substrate, so that the size can be scaled down by $\sqrt{\in_r}$. However, because of the strong electromagnetic coupling between the patch and the ground plane, a large amount of energy is trapped inside the high permittivity substrate, and a good radiator cannot be achieved. A magneto-dielectric substrate with moderate values of $\in_r$ and $\mu_r$, and a miniaturization factor of $n=\sqrt{\mu_r\in_r}$, may be a good substitute for the traditional only-dielectric substrate. It can provide more radiation to the outside region and help to create a wideband small antenna, but a major challenge exists in finding a suitable low-loss weak-frequency-dispersive magnetic material at the desired frequency. In contrast to the electric property, it is very difficult to establish magnetic polarization in a natural medium at the required high-frequency spectrum. The magnetism can be created artificially by, for example, embedding resonant loop circuits inside a dielectric material. This can provide a resonant behavior permeability function at any frequency of interest. To offer a magneto-dielectric-based small-size antenna with a wideband impedance feature, the permeability must have a large positive value. But, this means that the antenna should operate close to the resonant frequency of permeability, where the material inherently has a narrow bandwidth, and a wideband antenna design may not be fulfilled. Another approach for the design of a high-performance small antenna is to suppress the mutual coupling that exists between the antenna and its ground plane. This can be achieved using a reactive impedance surface (RIS) ground plane. An RIS meta-substrate has a reactive impedance behavior in which the image of a point source located above it can be envisioned as a distributed line source, which results in the reduction of the mutual coupling between the source and its image. Further, RIS shows inductive impedance phenomenon below the metasurface resonance, which can compensate for the capacitive property of the antenna and successfully tune the miniaturized antenna.

In all of the aforementioned designs, the antenna operating point is in the frequency region where the material constitutive parameters are positive. According to one embodiment of the present invention, a subwavelength antenna utilizes negative permeability natural materials to provide high-performance radiation characteristics. In contrast to the traditional positive materials-based antennas, the present invention is able to achieve a very small size negative-permeability antenna without requiring a very large permeability value. In one embodiment, the permeability value of the subwavelength antenna is about −2 and above. This has the advantage that one can make a small antenna radiating in a frequency spectrum that is far away from the material resonance, in the band where the material is less sensitive to the frequency dispersion and provides a lower loss.

FIG. 1 illustrates a negative permeability subwavelength antenna 10 according to one embodiment of the invention. The antenna 10 includes a hemispherical resonator 11 of radius a, composed of a material with a permittivity of $\in$ and a permeability of $\mu$. In one embodiment, the resonator 11 comprises a self-biased hexaferrite material or a multiferroic material. The hemispherical resonator 11 is provided over a grounded dielectric substrate 13 of thickness d and having a dielectric constant of $\in_{rs}$. The dielectric substrate 13 includes a ground plane 15 over the top surface of the substrate 13, and a stripline 17 on the bottom surface of the substrate 13. The resonator 11 is excited by a slot aperture 19 formed in the ground plane 15, which provides a y-axis directed magnetic dipole. As is more clearly illustrated in FIG. 2, which schematically illustrates the feed system 21 of antenna 10, the slot aperture 19 has a length of 2l and a width, W. The stripline 17 extends perpendicular to the slot aperture 19, and has a width, $w_f$, and a stub length of $L_s$.

Figure 2:
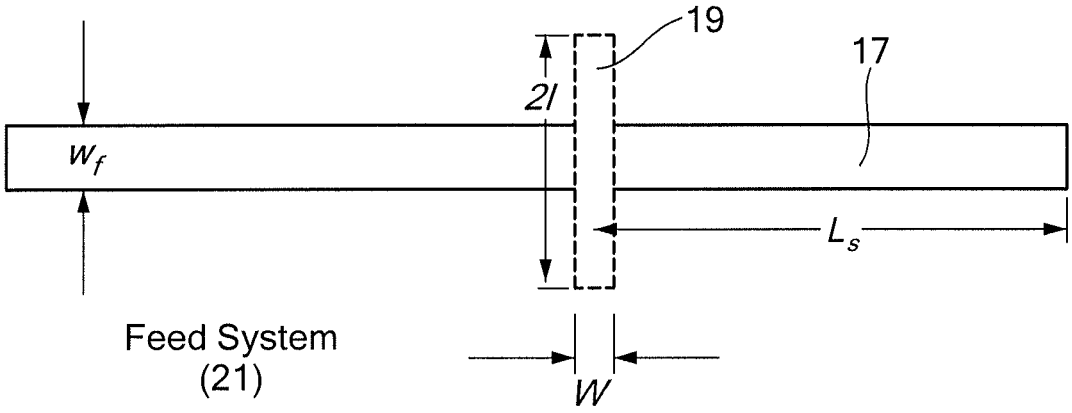
FIG. 2 is a schematic illustration of the feed system for the antenna of FIG. 1.

In an exemplary embodiment of the antenna 10 of FIGS. 1 and 2, the hemispherical resonator 11 has a radius, a, of 7.5 mm, the slot aperture 19 has a length, 2l, of 12 mm and a width, W, of 0.9 mm, and the stripline has a width, $w_f$, of 1.45 mm and a stub length, $L_s$, of 2.6 cm. The substrate 13 has a thickness, d, of 0.653 mm and a dielectric constant (permittivity), $\in_{rs}$, of 2.96.

The antenna 10 of FIGS. 1 and 2, comprised of a small hemisphere of natural magnetic material and excited by a slot feed, can resonate above the FMR of ferrite, where the material has a negative permeability (i.e., mu-negative).

The performance of this design can be characterized using a Green's function analysis. The electromagnetic fields are decomposed into contributions from the stripline and the slot excitation, and the scattered field due to the sphere discontinuity. Applying the second reciprocity theorem along with the assumption that the stripline has an infinite length allows the antenna configuration to be represented by the following equation:

$$[V_n] = \left\{ [Y^a_{mn} + Y^s_{mn}] + \frac{1}{2}[\Delta v_m][\Delta v_n]^t \right\}^{-1} [\Delta v_m] \quad \text{(Eq. 1)}$$

where $Y_{mn}^{s}$ contributes for the effect of the slot, $Y_{mn}^{a}$ is the admittance caused by the discontinuity of the sphere, and $\Delta v$ is associated with the slot's discontinuity voltage due to the stripline excitation. $Y_{mn}^{s}$ is obtained by deriving the Green's function $\tilde{G}_{yy}^{HM}$, which is the Fourier transform of $H_y$ at (x,y, 0) due to a unit ŷ-magnetic current located at (0,0,0).

$$\tilde{G}_{yy}^{HM} = \frac{-j}{\omega\mu_0}\left[ j\begin{pmatrix} k_1\cos k_1 d + \\ jk_2\varepsilon_{rs}\sin k_1 d \end{pmatrix} \frac{(\varepsilon_{rs}k_0^2 - k_y^2)}{k_1 T_m} - \frac{jk_y^2 k_1(\varepsilon_{rs}-1)}{T_e T_m} \right] + \frac{(k^2 - k_y^2)}{\omega\mu k_3}, \quad \text{(Eq. 2)}$$

$$k^2 = \omega^2\mu\varepsilon = (2\pi/\lambda)^2, \quad \text{(Eq. 3a)}$$

$$k_3^2 = k^2 - \beta^2, \ \mathrm{Im}k_3 < 0 \quad \text{(Eq. 3b)}$$

The above equations, as well as the definitions for $T_e$ and $T_m$, are known from D. M. Pozar, "A Reciprocity Method of Analysis for Printed Slot and Slot-Coupled Microstrip Antennas, *IEEE Trans. Antennas Propag.*, vol. AP-34, no. 6, pp. 1439-1446 (1986), he entire teachings of which are incorporated herein by reference.

One can determine $\Delta v$ by deriving the Green's function $\tilde{G}_{yx}^{HJ}$, which is the Fourier transform of $H_y$ at (x,y,0) due to a unit x̂-electric current element at (0,0,d). It is specified as $$\tilde{G}_{yx}^{HJ} = \frac{-jk_x^2(\varepsilon_{rs}-1)\sin k_1 d}{T_e t_m} + \frac{k_1}{T_e}. \quad \text{(Eq. 4)}$$

The admittance, $Y_{mn}^{a}$, results from the sphere discontinuity and has a direct impact on the resonant frequencies. To evaluate it, the Green's function for a y-directed magnetic field current located at the center of the sphere can be obtained. It is determined that:

$$\vec{G}_{M_y}^{H_{s_{inside}}} = \hat{a}_y\left( \frac{-1}{4\pi\omega\mu k} \cdot \frac{\sin\phi\sin\phi'}{r^2 r'} \sum_{n=1}^{\infty} n(n+1) b_n P_n(\cos\phi - \phi') \right) \times \hat{J}_n(kr')\hat{J}_n(kr) - \quad \text{(Eq. 5)}$$

where $$\frac{1}{4\pi\omega\mu}\frac{\sin\phi'\cos\phi}{rr'^2}\sum_{n=1}^{\infty} b_n \frac{\partial}{\partial\phi} \times P_n(\cos(\phi-\phi'))\hat{J}_n(kr')\hat{J}_n'(kr)\Bigg)$$

$$b_n = (2n+1) \times \frac{\frac{k_0}{\mu_0}\hat{H}_n^{(2)}(ka)\hat{H}_n^{(2)\prime}(k_0 a) - \frac{k}{\mu}\hat{H}_n^{(2)}(k_0 a)\hat{H}_n^{(2)\prime}(ka)}{\frac{-k_0}{\mu_0}\hat{J}_n(ka)\hat{H}_n^{(2)\prime}(k_0 a) + \frac{k}{\mu}\hat{J}_n'(ka)\hat{H}_n^{(2)}(k_0 a)}. \quad \text{(Eq. 6)}$$

The characteristic equation is then $$\Delta_n^{TE} = \frac{-k_0}{\mu_0}\hat{J}_n(ka)\hat{H}_n^{(2)'}(k_0a) + \frac{k}{\mu}\hat{J}_n'(ka)\hat{H}_n^{(2)}(k_0a). \quad \text{(Eq. 7)}$$

For characterizing a small sphere with $ka, k_0a \ll 0.5$, it will be very beneficial if one can obtain an approximated-simple formulation for the Green's function along the slot (y-axis). For this case, one can simplify (approximate) Equation (5) as follows:

$$\vec{G}_{M_y}^{H_{s_{inside}}} \cong \hat{a}_y \frac{-1}{4\omega\mu k}\sum_{n=1}^{\infty} n(n+1)\tilde{b}_n \frac{1}{(n+0.5)!^2}\left(\frac{k}{2}\right)^{2n+2}(yy')^{n-1} \quad \text{(Eq. 8)}$$

where $$\tilde{b}_n = (2n+1)\left(\left(\frac{k_0}{k}\right)^{2n+1}\frac{(n+1)\mu_r + n}{n\mu_r + n + 1} - 1\right) - j\frac{4n}{a\pi k}(n+0.5)!^2\left(\frac{4}{k^2a^2}\right)^2\frac{\mu_r - 1}{n\mu_r + n + 1}. \quad \text{(Eq. 9)}$$

The obtained formulations provide great advantage to successfully understand the physics of the radiator and obtain its radiation parameters. Substituting Equation 9 into Equation 8 shows that the scattering solution depends on $(yy'/a^2)^{n-1}$, and since along the slot $y,y'<l$, it can be concluded that the scattered Green's function inside the sphere is related to $(l^2/a^2)^{n-1}$. Note that the validity of quasi-static analysis, usually used to analyze this kind of structure, satisfied only if the antenna length is much smaller than the sphere size so that using only one term in Equation 8 is adequate. However, for relatively large slot length, one needs to take into account the effects of higher order terms.

The resonant frequency of a metamaterial-based small antenna can be predicted from the characteristic equation when $\Delta_n^{TE}$: 0, where $$\Delta_n^{TE} \cong j\left(\frac{k}{k_0}\right)^n \frac{k}{(2n+1)\mu}(n\mu_r + n + 1). \quad \text{(Eq. 10)}$$

It is observed that the antenna can resonate for $\mu_r = -(n+1)/n$, which is independent of the sphere size. The first dominant mode (n=1) offers resonant frequency at $\mu_r = -2$ (quasi-static model). Higher order modes resonate at other negative permeability values.

Using Equations 2, 4, and 5 (or 8), $Y_{mn}^s$ and $Y_{mn}^a$ can be derived in an integral equation form depending on the method of moment (MoM) basis functions of the voltage across the slot 19. The matrix (Equation 1) can be solved to obtain $[V_n]$, and from that the series slot impedance $Z_e$ can be calculated as:

$$Z_e = Z_c \frac{[\Delta v_n]^t [V_n]}{1 - \frac{1}{2}[\Delta v_n]^t [V_n]} \quad \text{(Eq. 11)}$$

where $Z_c$ is the characteristic impedance of the stripline. The $Z_e$ can be tuned by the open circuit stub length $L_s$, providing total antenna impedance of $$Z_{in} = Z_e - j\cot(\beta_f L_s) \quad \text{(Eq. 12)}$$

and $\beta_f$ is the propagation constant in the stripline.

Because of the symmetry of the antenna structure, and because the antenna is fed at its center, current distribution and magnetic field are even functions with respect to y, and hence from Equation 8, it is concluded that (n−1) should be an even number. This shows that the resonant frequencies obtained from Equation 10 occur for the odd mode numbers.

Forcing the continuity of tangential electric and magnetic field at the surface of the resonator, the scattering field outside the sphere is derived. For a small-size sphere, the radiated field is a magnetic dipole mode related to sin θ. Higher order modes provide the radiation patterns with odd-harmonic sinusoidal terms dependency.

Figure 3:
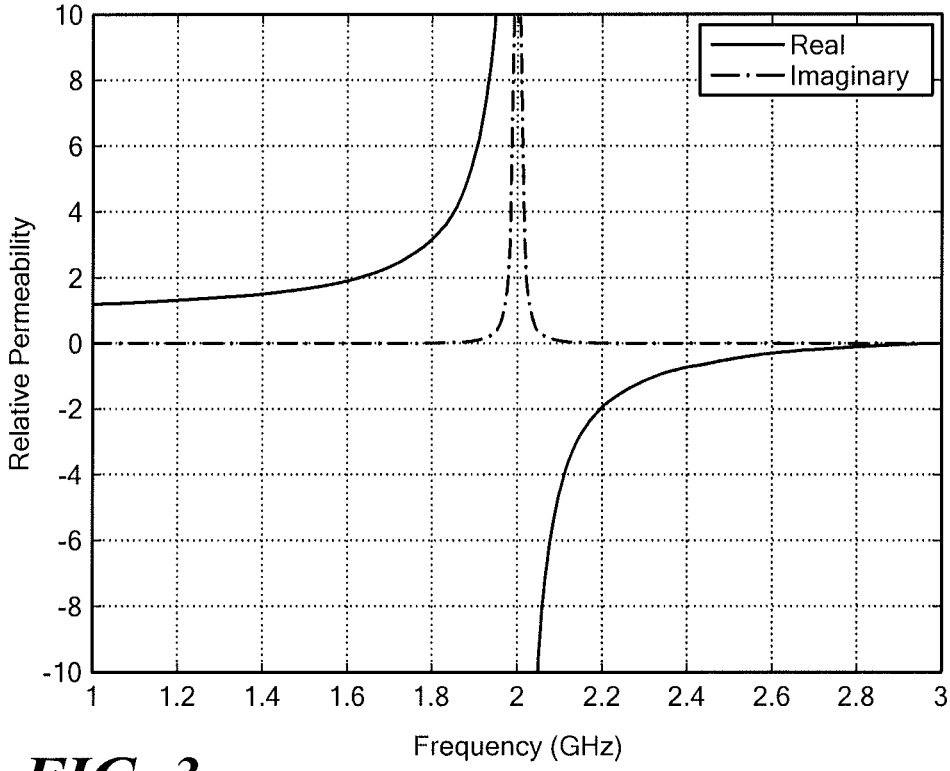
FIG. 3 is a plot of the Lorentzian permeability function of the negative permeability-based antenna.

The applicability of the above formulations can be validated by investigating the performance of a hemispherical antenna 10 as shown in FIGS. 1 and 2 constructed from a Lorentzian medium. The antenna 10 includes the dimensions described above (i.e., a=7.5 mm, 2l=12 mm and W=0.9 mm). A plot of the Lorentzian permeability function is shown in FIG. 3. The Lorenzian permeability function is given by $$\mu = \mu_0\left(1 - \frac{1}{2}\frac{\omega^2}{\omega^2 - (2\pi\times 2\times 10^9)^2 - j2\pi\times 4\times 10^6\omega}\right). \quad \text{(Eq. 13)}$$

Figure 4A:
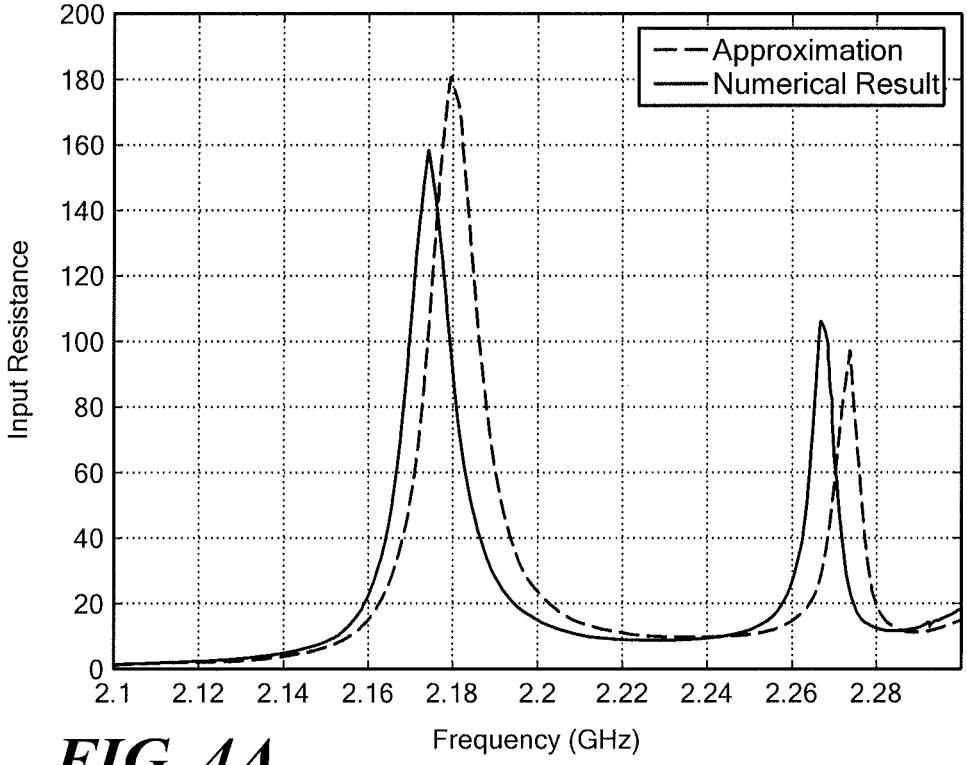
FIGS. 4A and 4B are plots showing the input resistance (FIG. 4A) and input reactance (FIG. 4B) of a negative permeability-based hemisphere antenna obtained using the approximated and exact Green's function analysis.
Figure 4B:
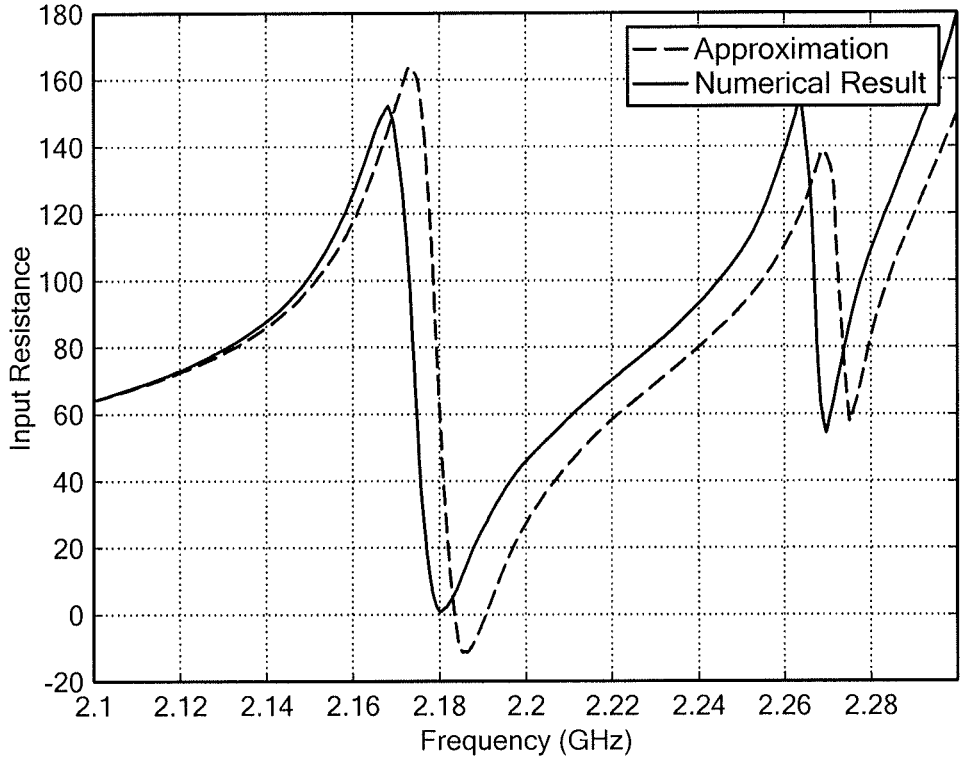
Figure 5:
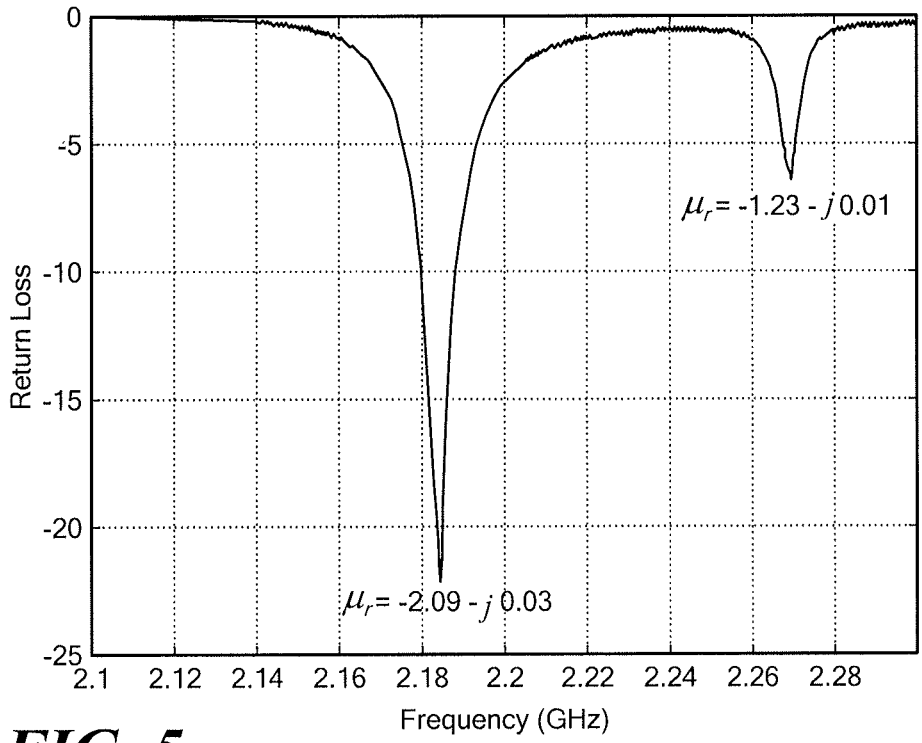
FIG. 5 is a plot of the return loss for a negative permeability-based hemispherical antenna.

Numerical results for the input impedance based on approximated and exact solutions are presented in FIGS. 4A and 4B, verifying the accuracy of the developed formulations. The resonant frequencies are around f=2.18 GHz and f=2.27 GHz, associated with $\mu_r = -2.09$ (fundamental mode) and $\mu_r = -1.23$ (third mode), respectively. These results successfully validate the applicability of Equation 10 in predicting the resonant frequenceies. As observed in FIGS. 4A and 4B, the first dominant mode can provide a wider impedance bandwidth. The return loss is shown in FIG. 5, where it demonstrates antenna impedance matching at the first resonant frequency. The −10 dB bandwidth is about 0.45%. Tuning the stub length properly matches the antenna at the first resonant frequency. The total size of the sphere at the fundamental mode is smaller than λ/9(ka=0.34). Due to the effect of the stripline and the slot there is a slight shift in the resonant frequency from what is expected.

The above formulations validate that a small hemisphere filled with a natural magnetic material and excited by a slot feed can resonate above the FMR of ferrite where the permeability is negative. Substituting the derived Green's functions in Equation 1 allows a system of equations that can be solved with the method of moment (MoM) technique efficiently, and the radiation characteristics of the negative permeability small antenna can be fully characterized. The resonance performance, impedance bandwidth and antenna efficiency can thus be obtained and optimized. Suitable magnetic materials for use in an antenna of the present invention include high-performance self-biased hexaferrite materials operating in the GHz spectrum with a loss tangent of about 0.05 above the resonance, which have been developed at the Microwave Magnetic Materials and Integrated Circuit ($M^3IC$) Center at Northeastern University in Boston, Mass. Also, applying a DC magnetic field to the antenna allows the antenna performance to be tuned to the frequency of interest and achieves a high performance radiation characteristic.

From the preceding discussion, it will be apparent that the material depolarization is the key factor for achieving a small radiator element. The shape of the structure mainly affects the performance of the impedance bandwidth. Thus, in addition to the hemispherical antenna design of FIG. 1, various other designs for a small-size antenna can be utilized.

Figure 6:
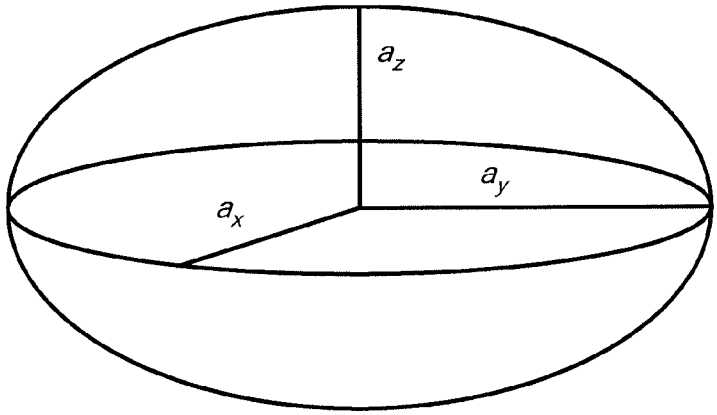
FIG. 6 illustrates the geometry of an ellipsoid.

Considering the geometry of the subwavelength antenna generally, FIG. 6 depicts the geometry of an ellipsoid with semi-axes $a_x$, $a_y$, and $a_z$ located in free-space and illuminated by an arbitrarily polarized magnetic field $H_0=\hat{x}H_{0x}+\hat{y}H_{0y}+\hat{z}H_{0z}$. It is assumed that the ellipsoid has material permeability μ, and its size is much smaller than the wavelength ($a_x,a_y,a_z \ll \lambda$). Through a rigorous static analytical model, the field inside the ellipsoid can is obtained as:

$$H_{int} = \hat{x}H_{0x}\left(1 - \frac{(\mu_r - 1)N_x}{1 + (\mu_r - 1)N_x}\right) + \hat{y}H_{0y}\left(1 - \frac{(\mu_r - 1)N_y}{1 + (\mu_r - 1)N_y}\right) + \hat{z}H_{0z}\left(1 - \frac{(\mu_r - 1)N_z}{1 + (\mu_r - 1)N_z}\right), \quad \text{(Eq. 14)}$$

where $N_i$ (i=x,y,z) is the depolarization factor determined from $$N_i = \frac{a_x a_y a_z}{2}\int_0^\infty \frac{ds}{(s + a_i^2)\sqrt{(s + a_x^2)(s + a_y^2)(s + a_z^2)}}. \quad \text{(Eq. 15)}$$

As can be seen, depolarization factors $N_i$ play a critical role in the performance of induced magnetic field. The three depolarization factors for any ellipsoid satisfy $$N_x+N_y+N_z=1.$$

For a sphere, the three depolarization factors are equal to ⅓, and the internal field is along the excitation, either in the same or opposite direction. Other special cases include oblate spheroid, with $a_x=a_y>a_z$, and prolate spheroid, with $a_x>a_y=a_z$. Closed form expressions for Equation 15 can be derived for these cases. Oblate spheroid has $$N_z = \frac{1 + e^2}{e^3}(e - \tan^{-1} e),\ N_x = N_y = \frac{1}{2}(1 - N_z) \quad \text{(Eq. 16)}$$

where eccentricity is $e=\sqrt{a_x^2/a_z^2-1}$; and prolate spheroid has $$N_x = \frac{1 - e^2}{2e^3}\left(\ln\frac{1 + e}{1 - e} - 2e\right),\ N_y = N_z = \frac{1}{2}(1 - N_x) \quad \text{(Eq. 17)}$$

with eccentricity $e=\sqrt{1-a_y^2/a_x^2}$. The practical utility of the spheroidal cases is the fact that the oblate spheroid degenerates into a flat disk as $a_z$ becomes very small ($e\rightarrow\infty$), and the prolate spheroid approaches a rod-shaped structure as the eccentricity goes to one. For the flat disk, the depolarization factors are (0,0,1), and for the rod-shaped structure they are (0,½,½).

Some of the important physical aspects of Equation 14, considering an ellipsoid located in free-space under the influence of a +z-polarized magnetic field are addressed below. For the spherical geometry case, the internal field, $H_{int}$, is simplified to:

$$H_{int} = \hat{z}H_{0z}\left(\frac{3}{\mu_r + 2}\right). \quad \text{(Eq. 18)}$$

It is observed that the structure goes to resonance for $\mu_r=-2$. This feature was also observed from Equation 10 for the dominant mode. Changing the shape of the structure can have interesting impacts on the resonance performance. For example, consider the case of the geometry merging from a sphere to a flat disk with depolarization factors (0,0,1). In this case, it is obtained from Equation 14 that the disk can provide resonant condition at around $\mu_r=0$. Hence, by merging from a sphere to a disk, the required permeability for resonance moves from $\mu_r=-2$ to $\mu_r=0$. By changing the structure shape from a sphere to a long rod, the required permeability moves from $\mu_r=-2$ to $\mu_r=-\infty$. Thus, subwavelength structures having other shapes besides a sphere can radiate if they are tuned at the appropriate negative permeability material values. This feature is very desirable in terms of fabrication, and can be used to successfully realize practical devices.

Figure 7:
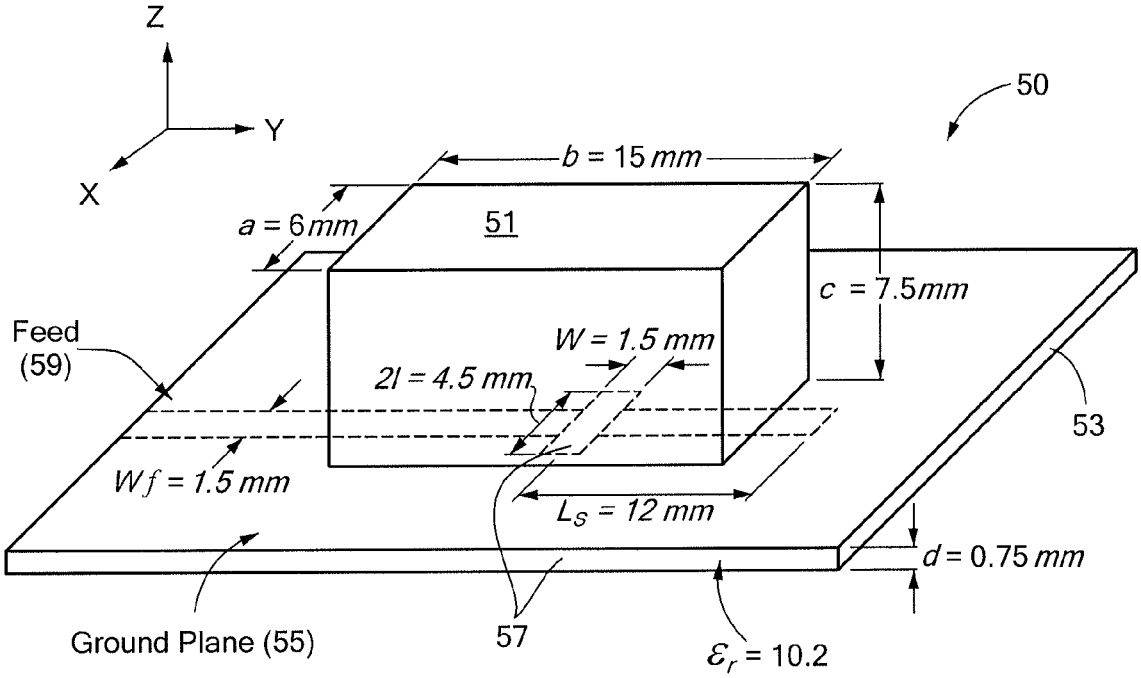
FIG. 7 illustrates a negative permeability-based slab radiator according to one aspect of the invention.
Figure 8A:
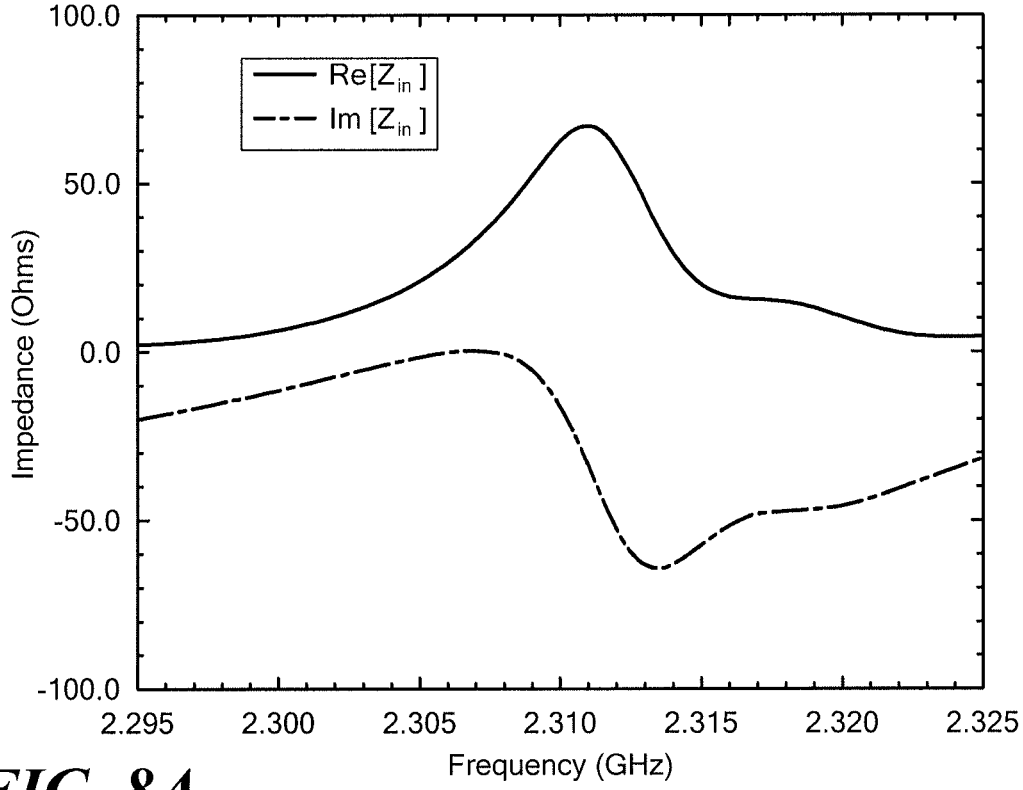
FIGS. 8A and 8B are plots showing the input impedance (FIG. 8A) and return loss performance (FIG. 8B) of the slab radiator of FIG. 7.
Figure 8B:
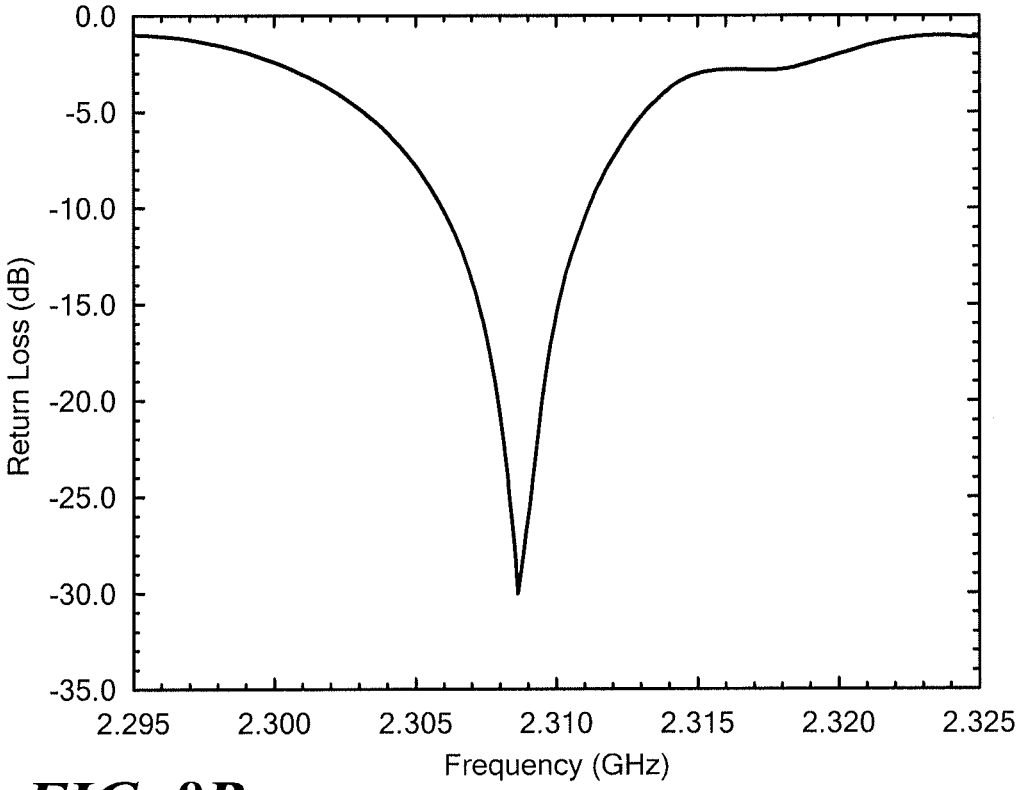

FIG. 7 illustrates a negative permeability subwavelength antenna 50 that is formed from a thin-film magnetic material slab 51, according to one embodiment of the invention. A thin-film slab 51 can be advantageous relative to the spherical topology of the antenna of FIG. 1 in terms of the ease of fabrication. The slab 51 is provided on a dielectric substrate 53, having a finite-sized ground plane 55 and a slot aperture 57 to couple the field from a stripline 59 to the antenna 50. The slab 51 is made of a hexaferrite material. The equivalent magnetic current of the aperture excitation can tune the capacitive property of the resonator at the proper mu-negative permeability value. A finite difference time domain (FDTD) analysis can be applied to comprehensively characterize the structure. The result of the input impedance is shown in FIG. 8A. The resonant frequency is determined at f=2.31 GHz associated with $\mu_r=-1$. Since the slab 51 has a different shape depolarization factor than that for the sphere, the required negative permeability for the resonance is different from what was theoretically obtained from Equation 10. In fact, the depolarization factor for the slab 51 is larger than that for the sphere, and thus a smaller negative permeability is required for providing the successful resonance. The return loss is shown in FIG. 8B, providing a good impedance match. The largest dimension of the slab is about $\lambda_0/10$, and a bandwidth of about 1% is observed. Optimizing the resonator shape and feeding system can result in an improved impedance-match and bandwidth performance.

Figure 9A:
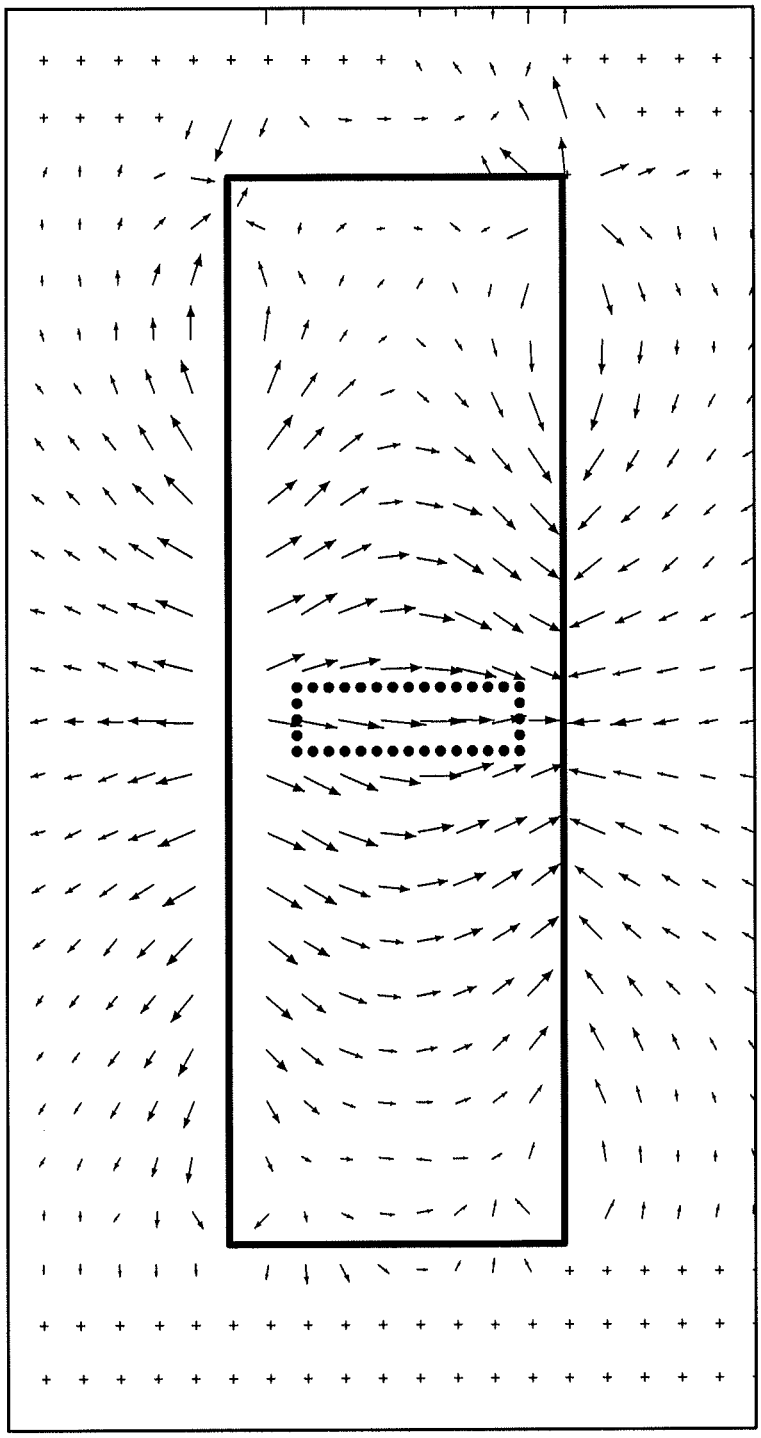
FIG. 9A illustrates the magnetic field pattern in the x-y plane for the slab radiator.
Figure 9B:
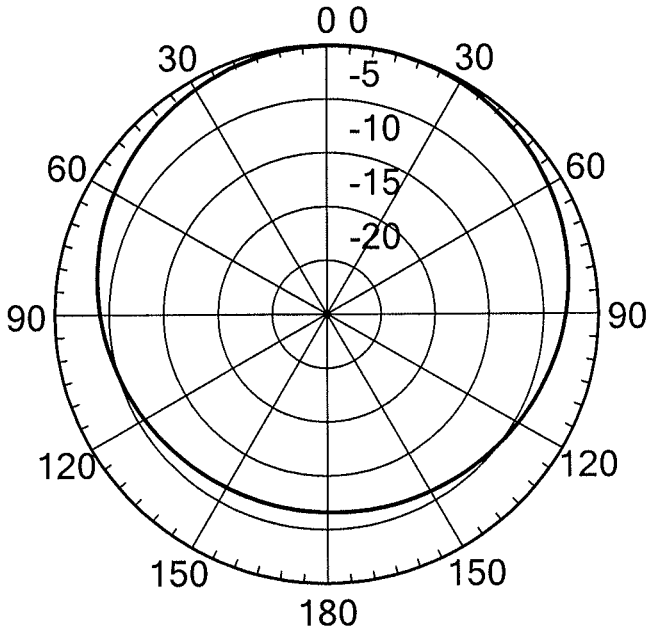
FIG. 9B illustrates the radiation pattern of the slab radiator.

The magnetic field pattern inside the slab is illustrated in FIG. 9A, representing an almost uniform depolarized field around the slot excitation at the antenna resonance. Note that the magnetic fields inside and outside the slab are in the opposite directions due to the negative value of permeability. The radiation pattern is similar to the field of a magnetic dipole, as obtained in FIG. 9B.

Tensor material parameters of a tunable hexaferrite, developed at Northeastern University's $M^3$IC Center, can be integrated into the design to exploit the concept of negative-permeability based antennas for use in novel small-size antennas. A major distinction between the present negative-permeability based antenna and traditional positive material based antennas is that to achieve a very small-sized radiator, a permeability of around −2 and above is required. Thus, one can operate away from the material resonance (above FMR), and the material is therefore less sensitive to the frequency dispersion and also provides a lower loss. In conventional positive material based small antennas, one needs to operate close to the material resonance (or metamaterial resonance) so that high materials parameters can be achieved (the larger the positive material parameters the smaller the antenna size). This has the drawbacks of high frequency dispersion and large loss material behaviors, resulting in degradation of antenna performance.

Negative Permeability-Based Array Antenna

Figure 10:
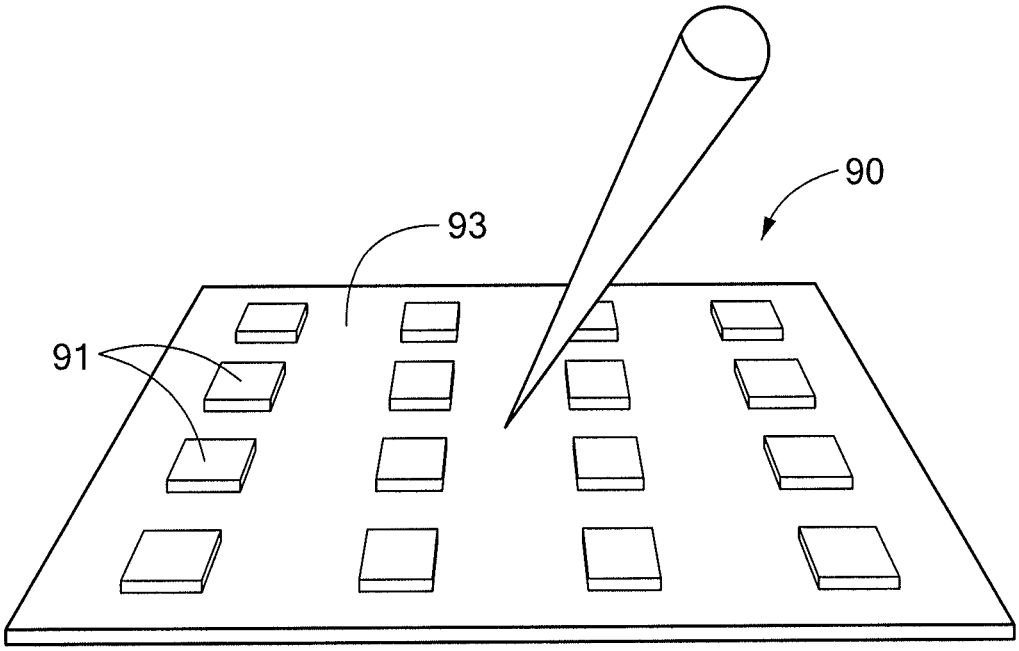
FIG. 10 illustrates an array configuration of subwavelength negative permeability-based antennas.

In another aspect of the invention, negative-permeability-based small antennas can be integrated into an array antenna. FIG. 10 illustrates an array antenna 90 that includes a plurality of subwavelength antenna elements 91 on a substrate 93. Each of the antenna elements 91 comprises a suitable negative permeability material, such as a hexaferrite material. The antenna elements 91 can have any suitable shape, such as a spheroid-shape, as shown in FIG. 1, or the slab shape of FIG. 7, or combinations of different shapes. Since the antenna element 91 has a very small size, the mutual couplings between the array elements can be greatly reduced. The array antenna 90 can also be tuned, where by applying a DC magnetic field, one can control the radiation performance and steer the beam in the appropriate direction. The present array antenna 90 can also provide a superdirective array characteristic.

Figure 11:
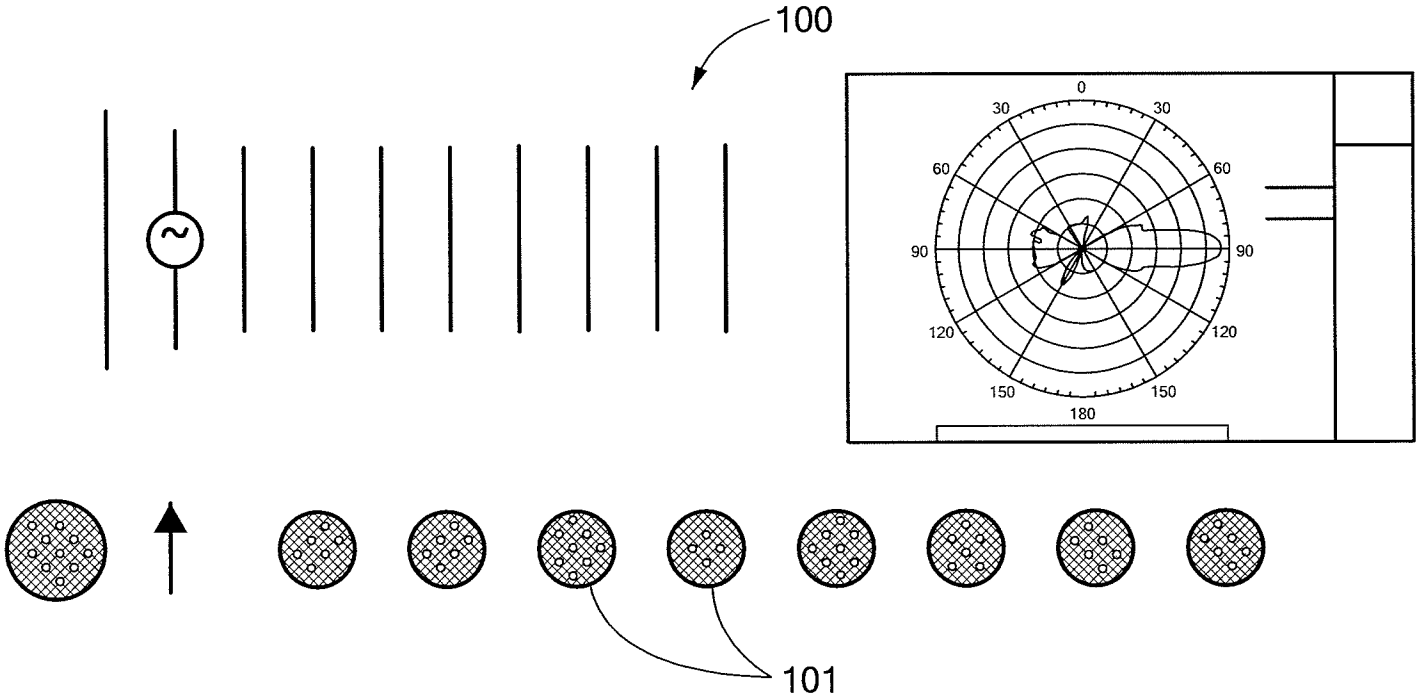
FIG. 11 schematically illustrates a negative permeability-based Yagi-Uda antenna.

FIG. 11 illustrates another embodiment of an array antenna 100. In this embodiment, the array antenna 100 is a Yagi-Uda-type antenna. A Yagi-Uda antenna that operates in the optics spectrum and utilizes negative permittivity ($\in_r=-2$) plasmonic spheres has recently been described by Engheta in *Science,* 317, 1698 (2007), the entire teachings of which are incorporated herein by reference. According to one aspect of the present invention, a Yagi-Uda antenna uses negative permeability materials and operates in the microwave spectrum. As shown in FIG. 11, a plurality of small particles 101, which can be spherical particles, are coated with a negative permeability material, such as a magnetic material, to form an array 100. Different material coatings can be optimized to achieve proper resonant features (different resonant sizes). Alternatively, or in addition, different shaped particles (resonators) can be used. As discussed earlier, the shape of the magnetic particle can control the location of the resonant frequency. It is interesting to note that at the resonant performance of a negative permeability sphere located in space, for instance at $\mu_r=-2$, both the magnitude and the phase of the scattering coefficient can be controlled. One can arrange an array of subwavelength magnetic particles operating in their appropriate negative permeability spectrum to tailor the phase of the scattering coefficients and achieve a reflectarray design.

The fact that a negative permeability particle (i.e., a ferrite sphere operating above its FMR) can offer a resonance radiator is a transformative concept, as such a particle can be used to design small antennas and antenna arrays. In designing a negative permeability based antenna array, one needs to consider the appropriate high-performance magnetic materials for the antenna elements, as well as the couplings between the array elements.

To provide a comprehensive computational engine for characterizing an array configuration including a large number of scatterers (dispersive permeability radiators), a surface integral equation (SIE) technique with a method of moment (MoM) discretization tool can be utilized. The traditional low order MoM with $\lambda/10$ feature size requires large computational resources. Also, commonly used boundary elements are in the form of flat triangular and quadrilateral patches, and may not provide enough flexibility and efficiency in modeling of structures with pronounced curvatures. To overcome these difficulties, an advanced higher order large-domain integral-equation technique with generalized curvilinear quadrilateral and hierarchical divergence-conforming polynomial MoM basic functions can be implemented. This technique decouples the total computational domain into array antenna elements and the remaining part of the slab, and determines a set of integral equations.

To achieve the field equivalence, a layer of equivalent surface electric current of density $J_s$, and a layer of surface magnetic current of density $M_s$, are placed on the boundary surface of each scatterer with the objective to produce total zero field in the remaining space. These current densities are given by $$J_s=\hat{n}\times H, M_s=E\times\hat{n} \quad \text{(Eq. 19)}$$

The scattered electric and magnetic fields can be expressed in terms of currents as $$E=L^e(J_s)+K^e(M_s), H=L^h(J_s)+K^h(M_s), \quad \text{(Eq. 20)}$$

where $L^e$, $K^e$, $L^h$ and $K^h$ are linear integro-differential operators that include the corresponding dyadic Green's functions. Boundary conditions on the surface of the $n^{th}$ scatterer can be written as:

$$\sum_{k=1}^{N}[L^e(J_s^k)+K^e(M_s^k)]_t^{outside}+(E_i)_t^{outside}=[L^e(-J_s^n)+K^e(-M_s^n)]_t^{inside} \quad \text{(Eq. 21a)}$$

$$\sum_{k=1}^{N}[L^h(J_s^k)+K^h(M_s^k)]_t^{outside}+(H_i)_t^{outside}=[L^h(-J_s^n)+K^h(-M_s^n)]_t^{inside}. \quad \text{(Eq. 21b)}$$

This introduces special polynomial/exponential entire-domain basis functions for equivalent surface electric and magnetic currents of the surface of array elements, and assumes the dielectric slab to be infinite, taking it into account exactly by considering the corresponding dyadic Green's function. The equations are simplified to a matrix equation. Characteristic basis functions (CBFs), as described in V. V. S. Prakash and R. Mittra, "Characteristic basis function method," *Microwave and Opt. Tech. Lett.*, vol. 36, no. 2, pp. 95-100 (January 2003), can be applied to incorporate the physics of the problem into the basis functions, enabling reduction of the matrix size significantly.

Therefore, utilizing a very capable computational technique, the performance of novel array antennas having negative permeability-based small radiator elements can be characterized, and the radiation behavior of the array can be tailored to the applications of interest. The magnitude and phase of the scattering coefficient for each antenna element can be optimized, taking into account the couplings, in order to manipulate the radiation pattern.

Negative Permeability-Based Near-Field Imaging

According to yet another aspect of the invention, a negative permeability material can be used to amplify evanescent fields of a source object. In certain embodiments, near-field imaging devices and methods include a negative permeability material.

Figure 12:
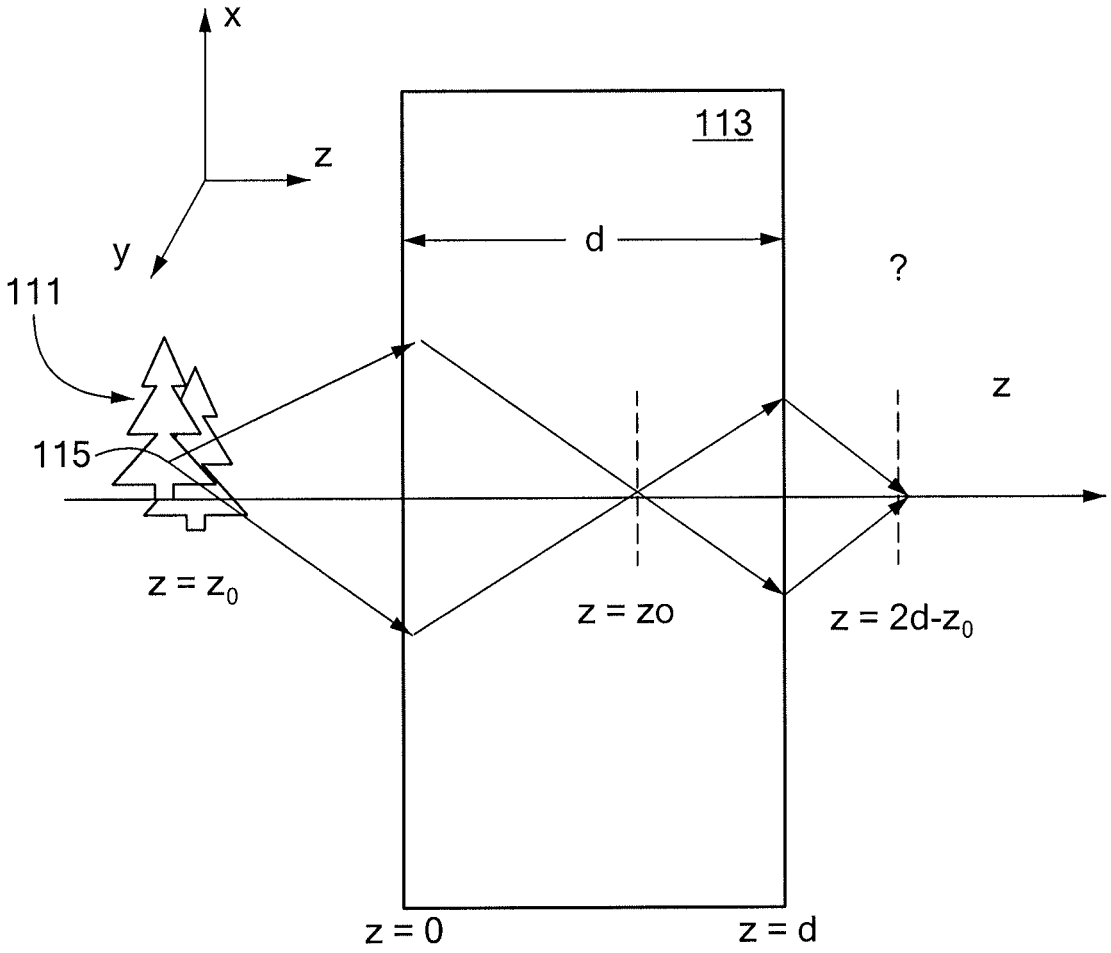
FIG. 12 schematically illustrates imaging an object using a metamaterial slab.

In recent years, there have been attempts to achieve high-resolution imaging using metamaterials. The objective has generally been to tailor the phase of the propagating waves as well as amplifying the evanescent waves. With reference to FIG. 12, which schematically illustrates imaging of an object 111 through a metamaterial slab 113, considering a point source 115 located at $-z_0$ in front of a metamaterial slab 113 with thickness d, the electric field can be represented in terms of the Fourier spectrum as:

$$E(r)=\int_{-\infty}^{\infty}A(k_x,k_y)\exp(ik\cdot r)dk_x dk_y \quad \text{(Eq. 22)}$$

where $k_z=\sqrt{k_0^2-(k_x^2+k_y^2)}$ stands for propagating components, and $k_z=i\sqrt{(k_x^2+k_y^2)-k_0^2}$ for evanescent waves exponentially decaying in the z-direction. For a p-polarized wave, applying the boundary conditions at the slab interfaces, the flowing equations for the propagating and evanescent components of the electric field spectrum are evaluated (it is assumed that at the frequency of interest, the slab is matched to the free space and has a refractive index $n=-1+in_i$):

Propagating Fields ($k_y^2<k_0^2, k_z=\sqrt{k_0^2-k_y^2}$):

$$\tilde{E}_x(k_y, k_z; 0 \le z \le d) = A(k_y)\exp(ik_y) \exp(ik_z z_0) \times \frac{2\left\{\begin{array}{l}(2-in_i)\exp(-ik_z z)(\exp(-k_z n_i z) - \\ in_i \exp[ik_z(z-2d)\exp[k_z n_i(z-2d)]\end{array}\right\}}{(2-in_i)^2 + n_i^2\exp(-2ik_z d)\exp(-2k_z n_i d)} \quad \text{(Eq. 23a)}$$

$$\tilde{E}_x(k_y, k_z; z \ge d) = A(k_y)\exp(ik_y y)\exp[ik_z(z+z_0)] \frac{4(1-in_i)\exp(-2ik_z d)\exp(-k_z n_i d)}{(2-in_i)^2 + n_i^2\exp(-2ik_z d)\exp(-2k_z n_i d)} \quad \text{(Eq. 23b)}$$

Evanescent Fields $(k)_y^2>k_0^2, |k_z^2|=\sqrt{k_y^2-k_0^2}$):

$$\tilde{E}_x(k_y, k_z; 0 \le z \le d) = A(k_y)\exp(ik_y)\exp(-|k_z|z_0) \times \frac{2\left\{\begin{array}{l}(2-in_i)\exp(|k_z|z)(\exp(-i|k_z|n_i z) - \\ in_i \exp[-|k_z|(z-2d)\exp[i|k_z|n_i(z-2d)]\end{array}\right\}}{(2-in_i)^2 + n_i^2\exp(2|k_z|d)\exp(-2i|k_z|n_i d)} \quad \text{(Eq. 24a)}$$

$$\tilde{E}_x(k_y, k_z; z \ge d) = A(k_y)\exp(ik_y y)\exp[-|k_z|(z+z_0)] \frac{4(1-in_i)\exp(2|k_z|d)\exp(-i|k_z|n_i z)}{(2-in_i)^2 + n_i^2\exp(2|k_z|d)\exp(-2i|k_z|n_i d)} \quad \text{(Eq. 24b)}$$

The field at any plane is the summation of the propagating and evanescent components as:

$$\tilde{E}_x = \int_{k_y^2 \le k_0^2} \tilde{E}_x^{Pr\,opag.}(k_y, k_z)\,dk_y + \int_{k_y^2 > k_0^2} \tilde{E}_x^{Evan.}(k_y, k_z)\,dk_y \quad \text{(Eq. 25)}$$

From Equations 24a and 24b, one can observe that the evanescent field grows through the slab (from the first to the second surface) and then decays when it exits the slab surface towards the image plane. This behavior contributes to the second integral term in Equation 25. The effect of the first integral term in Equation 25 is in the propagating components (Equations 22a and 22b), where the phases of the propagating waves are corrected in the image planes (one image is inside the slab at $z=z_0$ and the other one is outside the slab at $z=2d-z_0$). Balancing between these two terms recovers the source field distribution in the image planes. However, in reality, because of the loss of the slab material and the finite transverse size for the slab, the above condition may not be fulfilled. For instance, if the slab has a small size in the transverse direction, only a portion of the propagating waves is tailored in the image plane, and thus one cannot see the image. Instead, a decaying field profile is observed. Or, if the slab is constructed from dispersive lossy materials, the evanescent waves cannot be amplified as is required, and the image resolution is reduced. Another issue is the depth detection where the sources located at different distances from the slab cannot be amplified in such a way to be reconstructed in the image side. Because of these issues, all the currently-proposed metamaterial-based imaging systems function properly only for an object located very close to the metamaterial slab surface. In this case, one does not need to tailor the phase of the propagating waves, and amplifying the evanescent fields is sufficient to obtain the image (since the source is located in a plane next to the slab surface-near field manipulation). This is why Pendry's "Poor Man's Lens" can function properly. Pendry illustrated that a negative permittivity plasma with $\in_r=-1$ (in optics) can reconstruct an image successfully.

In one aspect of the present invention, a negative permeability material, such as a ferrite, can be used for near-field imaging of objects in the microwave spectrum.

In one embodiment, negative μ material layers can be used for evanescent field enhancement and subwavelength field manipulation. This is a significant development for several emerging fields, such as imaging and sensing.

For a point source located next to a slab (with arbitrary material parameters), the electromagnetic field can be expressed as $$E_{iz} = \frac{-jIl}{8\pi\omega\varepsilon_i}\cos\phi \int_{-\infty}^{\infty} dk_\rho k_\rho^2 H_1^{(2)}(k_\rho\rho)\left[\begin{array}{c} e^{jk_{iz}z} - \\ \tilde{R}_{i,i+1}^{TE} e^{-jk_{iz}(z+2d_i)} \end{array}\right], \quad \text{(Eq. 26)}$$

where $$\tilde{R}_{i,i+1} = \frac{\tilde{R}_{i,i+1} + \tilde{R}_{i+1,i+2}e^{-j2k_{i+1,z}(d_{i+1}-d_i)}}{1 + R_{i,i+1}\tilde{R}_{i+1,i+2}e^{-j2k_{i+1,z}(d_{i+1}-d_i)}}. \quad \text{(Eq. 27)}$$

Figure 13:
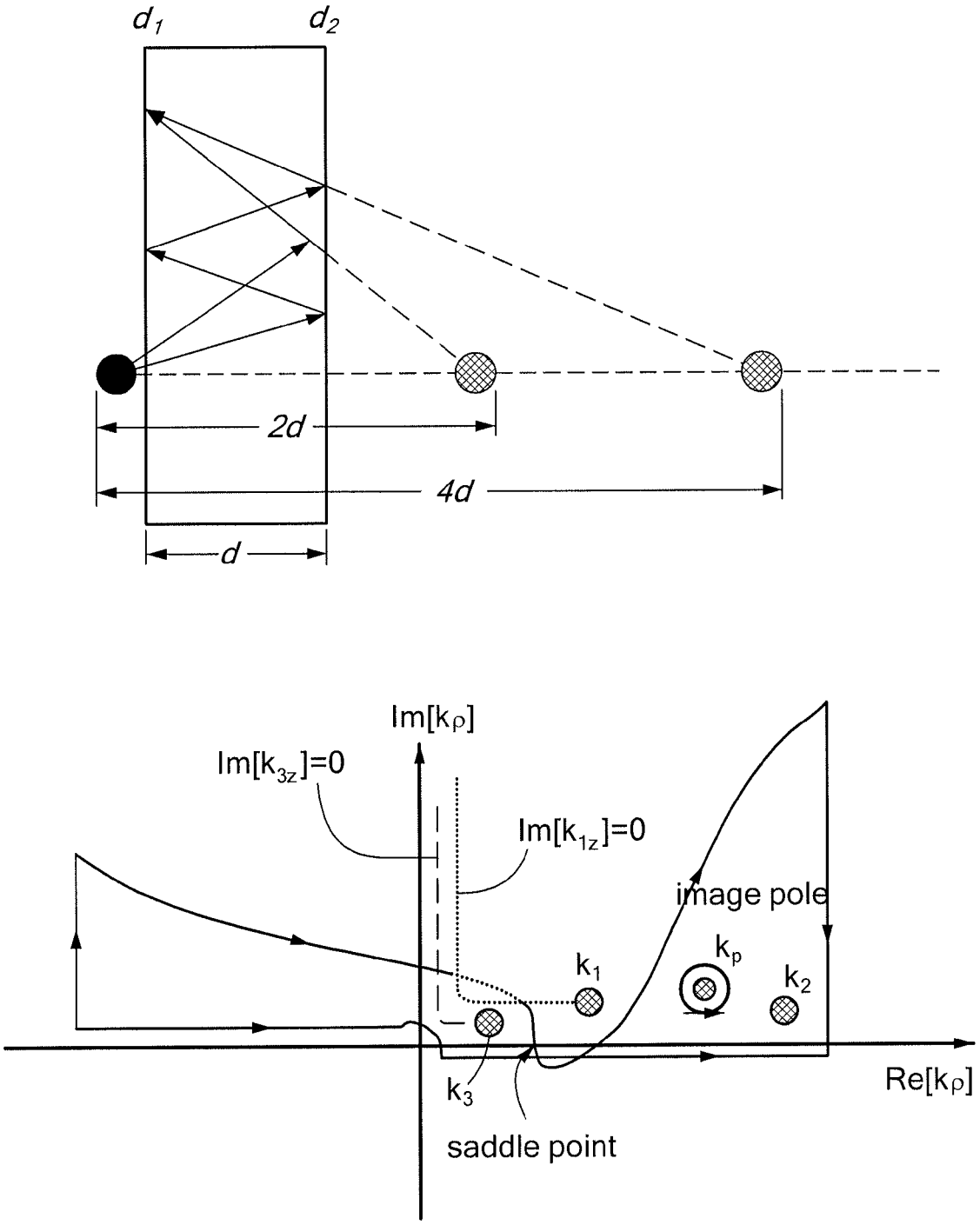
FIG. 13 illustrates a negative parameter slab and its Sommerfeld integration path.

The poles of Equation 27 ($1+R_{12}R_{23}e^{-j2k_{i+1,z}(d_{i+1}-d_i)}=0$) play an important role in achieving the desired physical phenomena of a device. The locations of the poles are illustrated in the complex $k_\rho$-plane in FIG. 13. Depending on the materials properties of the layers, the roots of Equation 27 can be corresponded to guided modes, leaky waves, or surface waves. It can be obtained that if the slab has a negative ∈ or a negative μ material, the transmission coefficient provides a pole $k_\rho$ (see FIG. 13) which contributes to the Sommerfeld integral calculation, and its field is given by:

$$E_{1z}^{RP} \approx \frac{-Il}{8\pi\omega\varepsilon_1}\frac{k_P^3}{k_{1zP}}\sqrt{\frac{2}{j\pi k_P\rho}}\, e^{-jk_P\rho-\alpha_{1P}(z+2d_1)}A^{TM}, \quad \text{(Eq. 28)}$$

where $A^{TM}=2\pi j\mathrm{Res}[R_{12}(k_P)]$ (Res stands for "residue"). This field decays exponentially away from the surface and guides along the surface. The mode is a surface wave that can be excited by an evanescent field.

Figure 14:
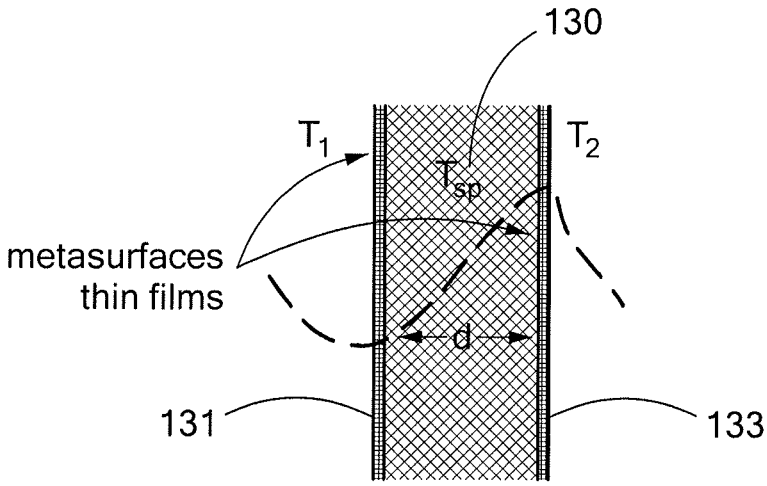
FIG. 14 illustrates a negative permeability-based near-field imaging device according to the invention.

From the above analysis, it is observed that a decaying field can launch a guided mode along the surface of a negative permittivity (or permeability) medium. In one embodiment, shown in FIG. 14, two thin films 131, 133 are located adjacent to the boundaries of a low dielectric slab 130. The thin films 131, 133 can be ferrites operating in their negative permeability bands. The low dielectric slab 130 comprises a low dielectric material, and can be air. Coupling between these layers 131, 133 enhances the decaying fields from one surface to the other. The parameters of the layers 131, 133 and their couplings can be optimized through the mathematical Sommerfeld analysis and matrix representation for each of the layers, as below:

$$T_{dev} = T_2 T_{sp}(d) T_1 = \begin{pmatrix} a & b \\ c & d \end{pmatrix}\begin{pmatrix} \exp(-jk_n d) & 0 \\ 0 & \exp(jk_n d) \end{pmatrix}\begin{pmatrix} a & b \\ c & d \end{pmatrix} \quad \text{(Eq. 29)}$$

-continued $$T_{metasurface} = \begin{pmatrix} 1 - \frac{\eta_0}{2Z_g} & -\frac{\eta_0}{2Z_g} \\ \frac{\eta_0}{2Z_g} & 1 + \frac{\eta_0}{2Z_g} \end{pmatrix} \quad \text{(Eq. 30)}$$

Equation 30 represents the matrix form of the magnetic thin films (impedance metasurfaces), where at their appropriate negative permeability values they support the resonant surface waves that are required for amplifying the object evanescent waves and reconstructing the near-field image.

Figure 15:
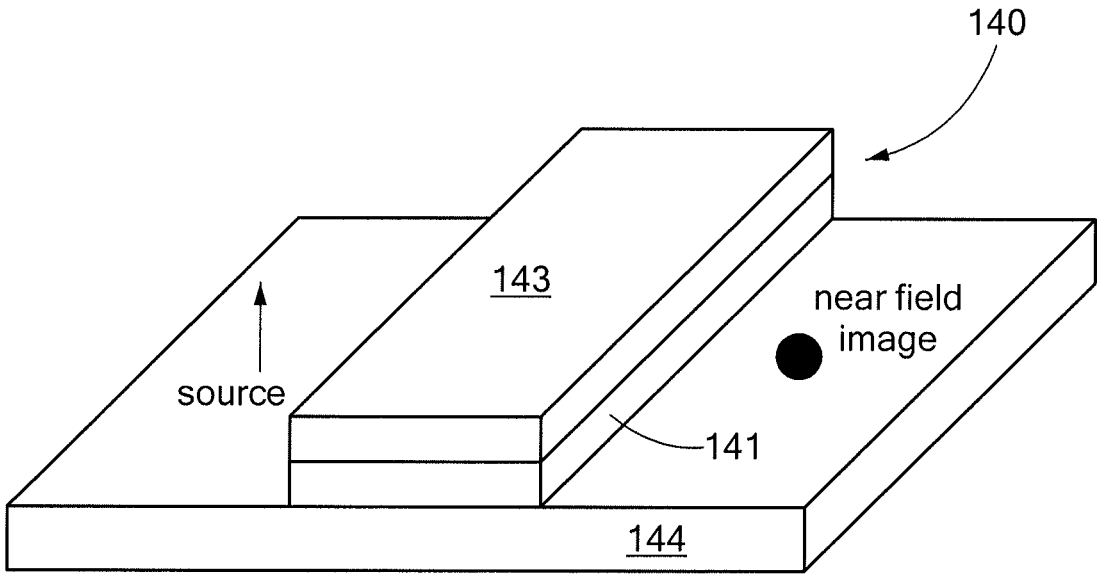
FIG. 15 illustrates an alternative embodiment of a near-field imaging device having a negative permeability film sandwiched between dielectric layers.

Other configurations can be employed for near-field imaging using negative permeability-based materials. For example, FIG. 15 illustrates a multi-layer structure 140 having a magnetic thin film layer 141 sandwiched between two dielectric layers 143, 144. The magnetic thin film 141 operates in a negative permeability band to promote subwavelength backward wave guiding. As a result, the evanescent fields are coupled to surface waves, enhancing the image performance. The negative permeability-based surface-waves concepts offer a profound impact on state-of-the-art sensing applications, such as bio and molecular sensors, and near field manipulating devices.

High-Performance Magnetic Materials

The previously-described negative permeability-based devices can be enhanced by utilizing the appropriate high-performance magnetic materials, including, for example, multifunctional self-biased and DC-biased hexaferrites. Preferred materials for the devices of the present invention include low-loss magnetic materials at GHz frequencies.

According to one aspect, the negative permeability-based devices of the invention function above the ferromagnetic resonance (FMR) of magnetic materials, and their required negative permeability values are relatively small. Thus, one can operate away from the magnetic resonance of the material, so that low-loss permeability can be achieved. Furthermore, away from the FMR, the frequency dispersion of the magnetic material is weak, and hence better electromagnetic device characteristics can be established.

For a typical self-biased hexagonal ferrite, where the material shows very strong anisotropic-dispersive behavior without applying an external DC field, the permeability tensor with easy magnetization axis along the z-direction (parallel to the propagation direction) is given by $$\bar{\mu}(\omega) = \mu_0 \begin{bmatrix} 1 + \chi_m(\omega) & j\kappa(\omega) & 0 \\ -j\kappa(\omega) & 1 + \chi_m(\omega) & 0 \\ 0 & 0 & 1 \end{bmatrix}, \quad \text{(Eq. 31)}$$

where the susceptibilities are $$\chi_m(\omega) = \frac{(\omega_0 + j\omega\alpha)\omega_m}{(\omega_0 + j\omega\alpha)^2 - \omega^2}, \quad \text{(Eq. 32)}$$

$$\kappa(\omega) = \frac{\omega\omega_m}{(\omega_0 + j\omega\alpha)^2 - \omega^2}. \quad \text{(Eq. 33)}$$

In these equations, $\alpha$ is the damping constant, $\omega_0=\gamma_m H_A$ is the precession frequency where $\gamma_m$(=2.8 GHz/kOe) is the gyromagnetic ratio and $H_A$ is the anisotropy field, and $\omega_m=\gamma_m 4\pi M_s$ where $M_s$ is the static magnetization. For a typical hexaferrite with anisotropy field of $H_A$=8 kOe and static magnetization of $4\pi M_s$=4kG, one evaluates $\omega_0=2\pi\times22.4\times10^9$ (rad/s) and $\omega_m=2\pi\times11.2\times10^9$ (rad/s). Considering a linewidth of $\Delta H$=300 Oe, the damping constant around $\alpha$=0.01 is determined. At for instance frequency, f–25 GHz($\approx$1.1 $f_0$), a permeability of around −1.5 with loss tangent of 0.06 are estimated. The permittivity of hexaferrite can be around $\in=18\in_0$ with loss tangent of about tan $\delta_e$=0.005.

The significance of natural magnetic materials operating in their negative permeability spectrum for use in state-of-the-art electromagnetic devices is readily apparent. Small antennas, array antenna configurations, and enhanced near-field imaging are some of the applications well-suited to the present negative permeability-based materials. It is demonstrated that a subwavelength antenna can be successfully designed using a negative $\mu$ medium. Since the operating frequency is away from the FMR, the low-loss and less frequency dispersion permeability can be used. The concept can be extended to achieve tunable array antennas and reflectarray configurations, steering a radiation beam in the appropriate direction. Theoretical and advanced computational models are developed to comprehensively characterize the performance of negative permeability-based antennas and to optimize novel array structures. Application of negative $\mu$ thin film ferrites for enhancing the evanescent waves and near-field manipulation imaging is also described.

It will be understood that other devices can employ the negative permeability material as described herein. The fact that a negative permeability particle can provide a high scattering coefficient at its resonant polarization creates unique opportunities for novel RF devices. RF tagging is another application where one can use an array of small spheres that respond to an incoming wave. Combinations of negative permeability materials with positive parameter materials can also enable new material properties. In H. Mosallaei and K. Sarabandi, "Magneto-Dielectrics in Electromagnetics: Concept and Applications," *IEEE Trans. Antennas Propagat.*, vol. 52, no. 3, pp. 649-660 (August 2007), the entire teachings of which are incorporated herein by reference, it was demonstrated how the novel arrangement of materials can offer different types of behaviors, namely series or parallel circuit models and elements, as $$\mu_{i0} = \mu_{i1}\frac{L_i}{\Lambda_i} + \mu_{i2}\left(1 - \frac{L_i}{\Lambda_i}\right) \quad \text{(Eq. 35)}$$

$$\frac{1}{\mu_{ie}} = \frac{1}{\mu_{i1}}\frac{L_i}{\Lambda_i} + \frac{1}{\mu_{i2}}\left(1 - \frac{L_i}{\Lambda_i}\right). \quad \text{(Eq. 36)}$$

The present invention can provide a new paradigm for producing state-of-the-art tunable RF components and systems.

While the invention has been described in connection with specific methods and apparatus, those skilled in the art will recognize other equivalents to the specific embodiments herein. It is to be understood that the description is by way of example and not as a limitation to the scope of the invention and these equivalents are intended to be encompassed by the claims set forth below.

What is claimed is:

1. An antenna, comprising:

a substrate; and an antenna element on the substrate, the antenna element comprising a magnetic material having a negative permeability parameter over a selected frequency spectrum, and the antenna element resonates at a frequency within the selected frequency spectrum, wherein the said selected frequency spectrum is above the material resonance.

2. The antenna of claim 1, wherein antenna element resonates at a microwave frequency.

3. The antenna of claim 1, wherein the antenna element is tunable.

4. The antenna of claim 1, wherein the magnetic material comprises ferrite.

5. The antenna of claim 1, wherein the magnetic material comprises hexaferrite.

6. The antenna of claim 1, wherein the magnetic material comprises a multiferroic material.

7. The antenna of claim 1, further comprising:

a slot feed mechanism for exciting the antenna element.

8. The antenna of claim 1, wherein the substrate comprises a dielectric material having a ground plane over a surface of the dielectric material, the antenna element being provided over the dielectric material and the ground plane, and a slot feed being formed in the ground plane for exiting the antenna element.

9. The antenna of claim 1, further comprising a stripline feed mechanism.

10. The antenna of claim 1, wherein the permeability of the material comprising the antenna element is between zero and about negative two.

11. The antenna of claim 1, wherein the antenna element has a hemispherical shape.

12. The antenna of claim 1, wherein the antenna element has a slab configuration.

13. The antenna of claim 1, wherein at least one dimension of the antenna element has a length that is less than wavelength of radiation at the resonant frequency.

14. The antenna of claim 1, wherein the antenna comprises an array of antenna elements on the substrate.

15. The antenna of claim 1, further comprising:

a DC magnetic field source for tuning the resonance characteristics of the antenna.

16. An array antenna, comprising:

a substrate; and a plurality of antenna elements on the substrate, each of the antenna elements comprising a magnetic material having negative permeability parameter over a selected frequency spectrum, and each of the antenna elements resonate at a frequency within the selected frequency spectrum, wherein the said selected frequency spectrum is above the material resonance.

17. The array antenna of claim 16, wherein the antenna elements resonate at a microwave frequency.

18. The array antenna of claim 16, wherein the magnetic material comprises ferrite.

19. The array antenna of claim 16, wherein the magnetic material comprises hexaferrite.

20. The array antenna of claim 16, wherein the magnetic material comprises a multiferroic material.

21. The array antenna of claim 16, wherein the permeability of the material comprising the antenna elements is between zero and about negative two.

22. The array antenna of claim 16, wherein at least a portion of the antenna elements has a spheroid shape.

23. The array antenna of claim 16, wherein at least a portion of the antenna elements has a slab configuration.

24. The array antenna of claim 16, wherein the antenna elements have at least one dimension with a length that is less than the wavelength of radiation at the resonant frequency.

25. The array antenna of claim 16, further comprising:

a DC magnetic field source for controlling the radiation performance of the array antenna.

26. The array antenna of claim 25, wherein the DC magnetic field source steers a radiation beam in an appropriate direction.

27. The array antenna of claim 16, wherein the array antenna provides a superdirective array characteristic.

28. The array antenna of claim 16, wherein the array antenna comprises a Yagi-Uda antenna.

29. The array antenna of claim 28, wherein the antenna elements comprise a plurality of particles that are coated with a negative permeability material.

30. The array antenna of claim 29, wherein the particles are spherical.

31. The array antenna of claim 29, wherein the particles differ by at least one of material coatings or particle shape to provide different resonant features.

32. The array antenna of claim 29, wherein the array antenna comprises a reflectarray antenna.

33. A near-field imaging device, comprising:

a negative permeability magnetic material resonating at a frequency above the material resonance positioned proximate an object to be imaged, the negative permeability material configured to amplify evanescent waves from the object to provide a near-field object image reconstruction.

34. The near-field imaging device of claim 33, wherein the magnetic material comprises a ferrite.

35. The near-field imaging device of claim 33, wherein the magnetic material comprises a hexaferrite.

36. The near-field imaging device of claim 33, wherein the magnetic material comprises a multiferroic material.

37. The near-field imaging device of claim 33, wherein the imaging device operates in the microwave spectrum.

38. The near-field imaging device of claim 33, wherein the imaging device comprises a pair of negative permeability thin films adjacent to opposing sides of a low dielectric slab.

39. The near-field imaging device of claim 38, wherein the thin films comprise ferrites operating in their negative permeability bands.

40. The near-field imaging device of claim 38, wherein the low dielectric slab comprises air.

41. The near-field imaging device of claim 39, wherein coupling between the thin-film layers enhances decaying fields from one surface of the imaging device to another surface of the imaging device.

42. The near-field imaging device of claim 33, wherein the imaging device comprises a negative permeability thin film layer sandwiched between two dielectric layers.

43. The near-field imaging device of claim 42, wherein the thin film layer comprises a magnetic material operating in a negative permeability band to promote subwavelength backward wave guiding.

* * * * *